United States Patent [19]

Monreal

[11] Patent Number: 4,793,627

[45] Date of Patent: Dec. 27, 1988

[54] SKI HANDLES CONVERTIBLE TO STANDARD SKI POLES

[76] Inventor: F. Javier Monreal, 4242 Barker Hill Rd., Jamesville, N.Y. 13078

[21] Appl. No.: 171,013

[22] Filed: Mar. 21, 1988

Related U.S. Application Data

[63] Continuation-in-part of Ser. No. 70,227, Jul. 6, 1987, Pat. No. 4,744,584.

[51] Int. Cl.[4] ..... A63C 5/06

[52] U.S. Cl. ..... 280/606; 280/823; 280/824

[58] Field of Search ..... 280/606, 809, 819, 824, 280/823, 12 A, 12 H, 601

[56] References Cited

U.S. PATENT DOCUMENTS

| | | | |
|---|---|---|---|
| 2,490,183 | 12/1949 | Wheeler | 280/606 |
| 3,885,805 | 5/1975 | Solymosi | 280/606 X |
| 4,006,911 | 2/1977 | Kraus et al. | 280/606 X |
| 4,363,495 | 12/1982 | Henson | 280/12 H |

FOREIGN PATENT DOCUMENTS

| | | | |
|---|---|---|---|
| 847275 | 8/1952 | Fed. Rep. of Germany | 280/606 |

*Primary Examiner*—John J. Love
*Assistant Examiner*—Michael Mar

[57] ABSTRACT

A paired, sporting, ski-steering device for use with a pair of skis with the skier's feet locked in position by standard ski bindings, providing the skier with an upright handlebar for each ski, both skis being totally independent from one another. The handlebars are attached to the front of each ski at mid-position between the toe piece of the standard ski binding and the front tip of the ski. The handlebars telescopically adjust in height so when retracted to a short length they reach vertically from approximately the knee to the mid-thigh of the skier so he/she can use this ski steering device in a tucked-in position; when extended, these handlebars are easily and manually detachable from the skis and instantly become a full length ski pole adjustable to the skier's height and comfort. Various locking devices to readily lock/unlock these handlebars to the skis are described. The length adjustment of these handlebars is maintained/changed via a simple series of vertically aligned perforations in the telescopically fitting sections of the handlebars and a locking spring-loaded push button.

1 Claim, 2 Drawing Sheets

SKI HANDLES CONVERTIBLE TO STANDARD SKI POLES

CONTINUATION IN PART STATEMENT

This patent application is a continuation-in-part of applicant's earlier application Ser. No. 070,227, filed July 6, 1987, now U.S. Pat. No. 4,744,584.

BACKGROUND AND PURPOSE

The purpose of this patent application is to extend further the use and practicality of ski handles attached to a snow ski as per applicant's earlier mentioned U.S. Pat. No. 4,744,584. In that earlier mentioned patent application, handlebars attached to the ski are described. Nevertheless, while the basic concept works in actual skiing, in practical terms it becomes somewhat cumbersome and a nuisance due to the fact that one has to use regular, long ski poles to propel oneself on semi-flat ground, to get to the chair lift and to get to the point where the descent starts, and, in the mean time, having to carry (under one's arm or in a back pack) the described ski handles or handlebars; once one starts the descent using the handlebars in a tucked-in position the ski poles now become the nuisance and one needs to tie them to one's back, all of which results in a loss of time. The loss of time can also be unpleasant since skiing is usually in very cold conditions where, like every one else, one likes to move fast.

By this invention the ski handles are interconvertible in seconds into ski poles and one does not need to carry a back pack. Furthermore, it adds the clear advantage of providing the skier almost instantly, at the push of a couple of buttons, with the choice of standard "skiing-with-poles" or "skiing-with-built-in-handles". The same device extended is a ski pole, and when telescopically shortened, a steering ski handlebar.

The prior art was cited in applicant's earlier mentioned patent. None of the existing or proposed standard ski poles can work as built-in handlebars, and conversely, none of the proposed ski-steering devices attached to the front of the skis can be detached to serve as a pair of practical ski poles. No "scooting" devices (i.e. with handlebars up front) are so easily removed as in the invention herein, where the handles disengage at the push of a button.

BRIEF DESCRIPTION OF THE INVENTION

This sporting, paired device is an attachment mounted vertically at the front of snow skis. The device is made of light weight metal tubing or composite tubing and has a simple, push-button locking and lengthening (telescopically) provision. Non-slip sleeves cover the hand-grip portion of the handles. The bottom tip of the handles is firmly secured to the ski via various brackets or specially built bindings that easily release the handles at the will of the skier (also via push-button, spring-loaded mechanism). This easy release allows the skier to use the herein described handles while attached to the skis (with the skier in a tucked in position and grabbing the handles, as shown in FIG. 1), or as detached sticks which can be telescopically lengthened to become ordinary ski poles. Various types of attachment brackets or bindings are possible to achieve the firm hold/easy release which is an essential part of the invention. Several are described herein. Some are best for a firm hold, while others are best for an easy release.

Ice-jamming situations may make some types impractical.

DETAILED DESCRIPTION OF THE INVENTION

Figure 1:
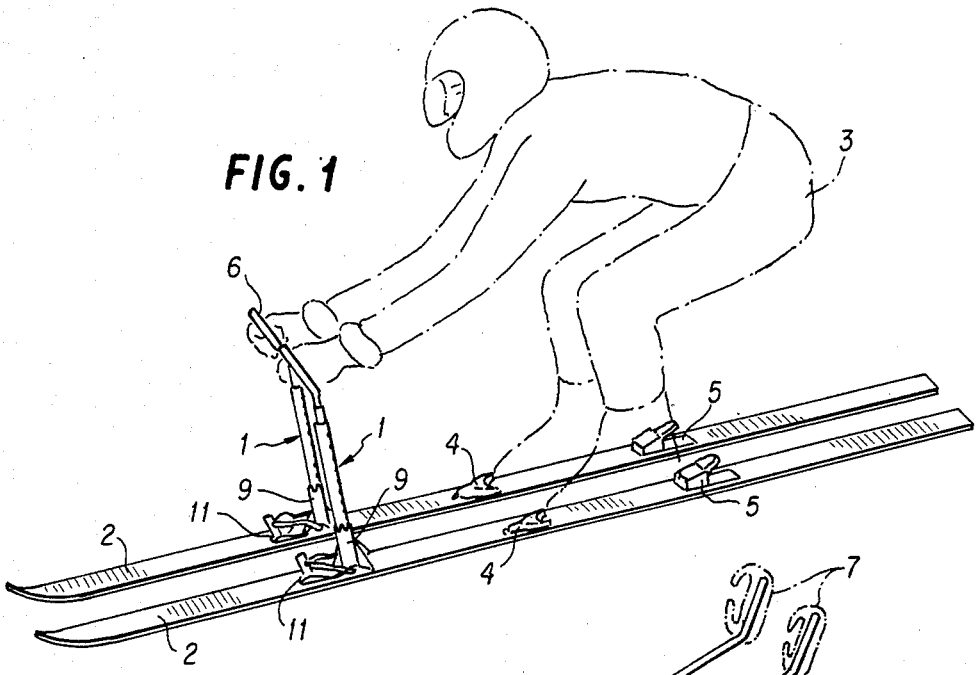
FIG. 1 Depicts a perspective, left lateral view of a skier in a tucked-in position holding on to the handlebars described herein FIG. 2 Depicts the instant invention, now in an extended position, for use as ordinary ski poles.

This sporting, paired device consists of a light weight metal or composite tubing, parted in two to three sections that telescope on one another to become fully or partially retracted and fully or partially extended. In FIG. 1, which shows the instant invention in actual use, the handles which the skier engages are marked with the numeral 1. The skis are marked by the numeral 2. The tucked-in skier, in dash-and-dot lines is marked by the numeral 3 with his/her feet locked in position by standard ski bindings that have a toe hold 4 and a heel hold 5.

The handles 1 have their top section slightly bent forward for a more convenient grasp by the skier. The area grasped has a non-slip rubberized sleeve or handgrip as shown in dotted line in FIG. 1 with the numeral 6 and in continuous line as shown in FIG. 2 where it is identified by the numeral 7.

Figure 2:
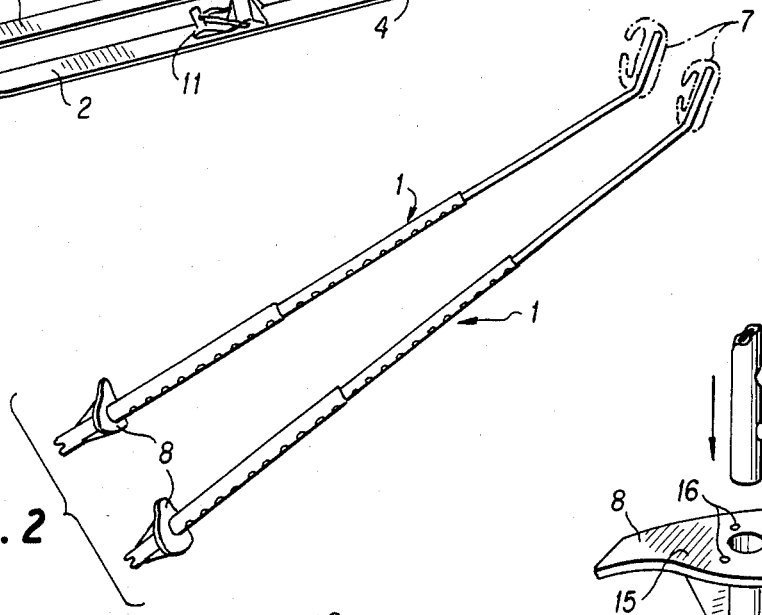
Figure 5:
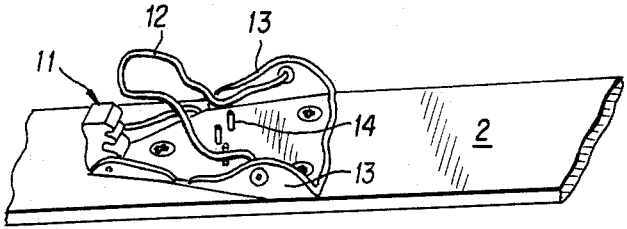
FIG. 5 Depicts a close look at the locking piece attached to the ski. This particular model of locking piece or bracket happens to be a standard Cross Country binding, specifically the widely used model manufactured by GEZE of W. Germany.

When the handle is fully extended in FIG. 2, it becomes a full length ski pole with its handgrip 7 at its top and with its "basket" 8 at its bottom. The basket 8 prevents the pole from going too deep in soft snow. This basket 8 has an important dual purpose: It serves as a true basket when the device is used as a ski pole as in FIG. 2, and it also serves as an attachment device 9 when turned upside down with its vertical short tubing pointing up as marked by the numeral 10 in several figures. When serving as an attachment device with its vertical tubing 10 pointing up, the attachment device 9 is capable of firmly engaging a standard cross country binding 11 as shown separately in FIG. 5 or in operation as in FIG. 1. This type of cross country binding is presently widely used and sold by GEZE of W. Germany. In its current market use, this binding is only meant to engage specially tipped cross country shoes. The binding 11 has a spring loaded curved bar 12 for holding the tip of a shoe (or in my invention, the attachment device 9, or reversed basket 8), raised sides 13 to prevent lateral displacement and three short vertical pins 14 to prevent a backward slip. The attachment device 9 or reversed basket 8, besides having a short vertical tube 10 that receives the bottom of the handle 1, also has a horizontal plate 15 specially shaped and tapered in its front for engaging the binding 11 at it's forwardmost location under the locking bar 12 and is provided with perforations 16 properly aligned for engaging the pins 14 of the binding 11.

The short vertical tubing 10 is strengthened in position via three or four wings 17, and the whole thing is welded together, or, best, casted into a single light weight block of aluminum or equivalent composite material. The short tubing 10 has, approximately 1" to 2" from its base, a perforation 18, capable of receiving snuggly a side push button 19 placed near the bottom of the handle 1. The tubing 10 is approximately 3" to 4" tall.

The handles 1 have a series of ±1" spaced-apart perforations capable of lining up those of one tube with those of another as shown extended in FIG. 2. The bottom of the highest and thinnest section that has the hand grip sleeve has only one perforation with a push button that is capable of engaging any of the perforations of the middle section. This middle section also has, in its lowest perforation, a push button capable of engaging any of the perforations of the lowest and widest section. This lowest and widest section also has, in its lowest perforation, a push button 19 capable of engaging the basket 8/attachment device 9. When fully retracted the handle is approximately under 20", and when fully extended, from 40" to 60". The bottom and middle sections are straight and the top section has the curved-forward hand-grip area. The respective outside diameters of these sections are approximately 1" for the widest section, $\frac{7}{8}$" for the middle section and $\frac{3}{4}$" for the thinnest section.

Figure 3:
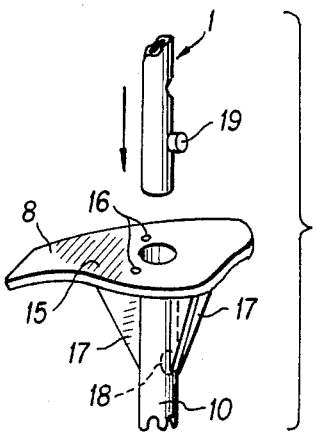
FIG. 3 Depicts a closer look at the bottom tip of the ski pole with its "basket" or bracket having its short tubing pointing downward for use as a standard ski pole.
Figure 4:
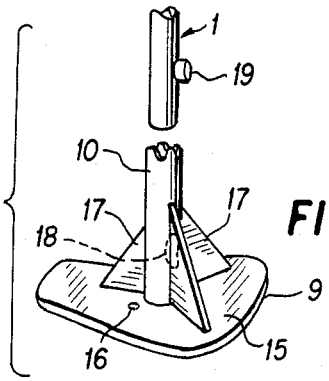
FIG. 4 Depicts a closer look at the bottom tip of the instant invention when used as a ski handle: here the basket or bracket is the same as in FIG. 3, but turned upside down so its horizontal plate can be slipped into the locking piece of the ski shown in FIG. 5.
Figure 6:
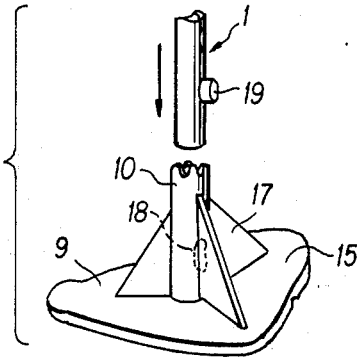
FIG. 6 Depicts another embodiment of the bottom "basket" or attachment piece of the ski handle, with a square ring or buckle at its front end and a longitudinal groove through the middle of its undersurface, capable of engaging existing "toe-holds" of Cross Country bindings which permit a pivoting action (upright) at the buckle point.
Figure 8:
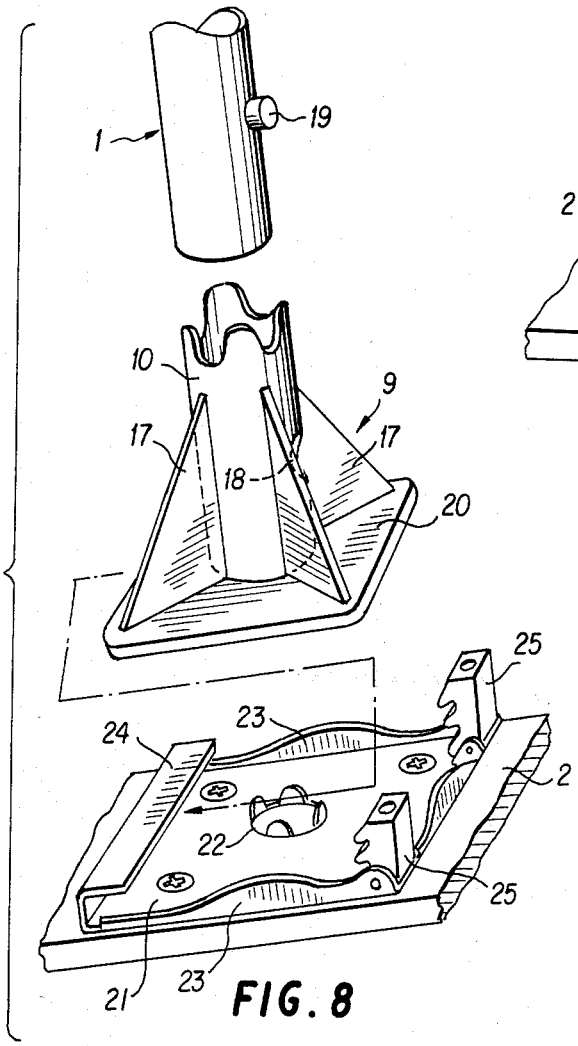
FIG. 8 Depicts still another embodiment of the square bracket of FIG. 7, but attachable to the ski by two spring-loaded "catch-hooks" and a hooked opposite side.

The attachment device 9 may have its horizontal plate tapered towards the front as in FIGS. 3, 4, and 6, or it may be rectangular, with rounded corners as in FIG. 8. In the FIG. 8 embodiment, the attachment device 9 can also be reversed upside down to become a ski pole basket as shown in FIGS. 2 and 3 with the vertical tubing 10 pointing down. In this case, with the attachment device 9 having a horizontal rectangular plate 20, the locking plate or binding 21 that goes on the ski is also rectangular and locks the attachment device 9 in place by means of slightly raised lips in a center perforation 22, slightly raised lateral sides 23, a raised-and-folded-over anterior side 24, and a pair of spring-loaded double hooked "catches" 25. The binding 21 is of course, permanently secured to the ski via four screws.

Figure 7:
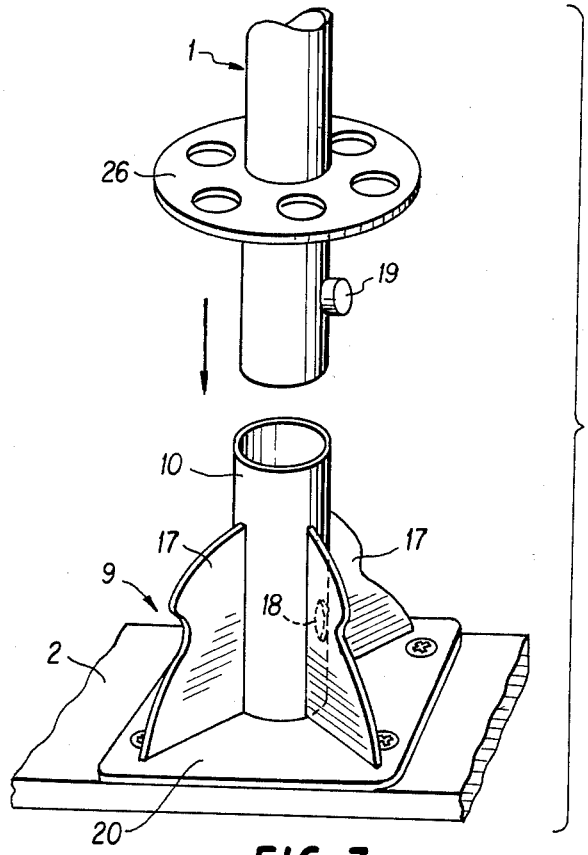
FIG. 7 Depicts still another embodiment of a rectangular shaped bracket which is screwed to the ski. Only the pole or handle pulls off the ski.

The attachment plate 9 can also be permanently secured to the ski as shown FIG. 7. In this embodiment, the "basket" or plastic prongs or wheel 26 is fixed on the pole or ski handle 1 approximately three inches from its bottom tip. The strengthening winglets 17 are then notched as shown in FIG. 7 to provide a catch for a rubberized or padded foam-and-pouch (not shown) that would serve as a cover for the attachment device 9 when the ski handles 1 are not being used as in this invention, but instead, the skier wants to use the same pair of skis in a conventional fashion.

What I now claim is:

1. A sporting, paired, ski steering device for use with a pair of skis having standard toe and heel downhill ski bindings mounted thereon, said device being capable of providing a snow skier, while the skier's feet are locked on said downhill ski binding, with hand steering controls of the skis, each member of the pair of said steering device being identical to one another and being releasably attached to each ski, each member of the pair comprising:

an upright handlebar made of at least two sections of snuggly fitting telescoping light weight metal tubes, said handlebar height being telescopically adjustable from 18" when retracted to 60" when fully extended, a plurality of round perforations located along the axial length of each lower tube section, a spring biased push button located at the lower end of each tube section, a curved handle portion formed at the upper end of the top tube section, and a non-slip rubberized sleeve surrounding said handle portion;

a basket for removable attachment to the bottom end of the lowest tube section of said upright handlebar, said basket comprising a short metal tube extending vertically from one side of a substantially horizontal plate, said short tube being capable of receiving the bottom end of said lowest tube section, said short tube having a perforation for receiving said spring biased push button of said lowest tube section, said plate being substantially pear shaped and having an aperture axially aligned with said short metal tube, and a plurality of perforations extending vertically through said plate; and a cross-country ski binding secured to the ski at approximately mid-distance between the front tip of the ski and the toe piece of said downhill ski binding, said cross-country ski binding having a plurality of vertically extending pins to be received within said perforations of said plate and a spring bar for securing said plate to said cross-country ski binding, wherein said handlebar may be used as a ski pole by inserting the botton end of said lowest tube section into said aperture of said plate and then into said short metal tube and wherein said handlebar may be secured to said ski by inserting the bottom end of said lowest tube section directly into said short metal tube and then securing said plate to said cross-country ski binding.

* * * * *